US012630340B2

(12) United States Patent
Gift et al.

(10) Patent No.: US 12,630,340 B2
(45) Date of Patent: May 19, 2026

(54) CHILD-RESISTANT CLOSURE

(71) Applicant: Berry Global, Inc., Evansville, IN (US)

(72) Inventors: Steven Gift, Lititz, PA (US); Jacob B. Robison, Marietta, PA (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 18/303,167

(22) Filed: Apr. 19, 2023

(65) Prior Publication Data

US 2023/0339658 A1 Oct. 26, 2023

Related U.S. Application Data

(60) Provisional application No. 63/332,883, filed on Apr. 20, 2022.

(51) Int. Cl.
*B65D 50/04* (2006.01)
*B65D 47/08* (2006.01)

(52) U.S. Cl.
CPC ..... *B65D 50/046* (2013.01); *B65D 47/08* (2013.01); *B65D 2215/02* (2013.01); *B65D 2547/06* (2013.01)

(58) Field of Classification Search
CPC .. B65D 47/08; B65D 47/0885; B65D 50/046; B65D 2215/02; B65D 2215/04; B65D 2251/1058; B65D 2547/06; B65D 2215/00; B65D 2215/1016; B65D 50/04; B65D 50/00; B65D 55/02
USPC ..... 215/216, 225, 235, 245
See application file for complete search history.

(56) References Cited

U.S. PATENT DOCUMENTS

| | | | |
|---|---|---|---|
| 3,853,157 | A | 12/1974 | Madaio |
| 4,022,352 | A | 5/1977 | Pehr |
| 4,493,348 | A | 1/1985 | Lemmons |
| 4,940,167 | A | 7/1990 | Fillmore |
| 5,205,431 | A | 4/1993 | Zinnbauer |
| 5,213,235 | A | 5/1993 | Miranda |
| 5,314,084 | A | 5/1994 | Folta |
| 5,356,017 | A | 10/1994 | Rohr |
| 5,573,516 | A | 11/1996 | Tyner |
| 5,620,434 | A | 4/1997 | Brony |

(Continued)

FOREIGN PATENT DOCUMENTS

| | | | |
|---|---|---|---|
| EP | 1424292 | A1 | 6/2004 |
| GB | 2512620 | A | 10/2014 |

(Continued)

OTHER PUBLICATIONS

Office Action (Non-Final Rejection) dated Jun. 7, 2024 for U.S. Appl. No. 17/899,924 (pp. 1-15).

(Continued)

*Primary Examiner* — Gideon R Weinerth
(74) *Attorney, Agent, or Firm* — Barnes & Thornburg LLP

(57) ABSTRACT

A closure includes a body that is adapted to mate with a container, a flip-top cap coupled to the body, and a hinge interconnecting the body and the flip-top cap. The body is configured to be mounted onto container to cover a discharge outlet formed in the container. The flip-top cap is configured to protect a product-dispensing spout formed on the body and block a child, for example, from accessing the product dispensing spout and removing contents from the container.

20 Claims, 8 Drawing Sheets

(56) References Cited

U.S. PATENT DOCUMENTS

| | | | | |
|---|---|---|---|---|
| 5,765,705 | A * | 6/1998 | Deubel | B65D 50/045 215/237 |
| 5,911,252 | A | 6/1999 | Cassel | |
| 6,065,648 | A | 5/2000 | Tauber | |
| 6,405,885 | B1 | 6/2002 | Elliott | |
| 6,866,164 | B2 | 3/2005 | Branson | |
| 7,077,176 | B2 | 7/2006 | Py | |
| 7,404,495 | B2 | 7/2008 | Keung | |
| 7,451,896 | B2 * | 11/2008 | Robinson | B65D 50/046 215/211 |
| 7,568,509 | B2 | 8/2009 | Py | |
| 7,798,348 | B2 * | 9/2010 | Sawyer | B65D 47/0809 220/283 |
| 8,211,082 | B2 | 7/2012 | Hasegawa | |
| 8,272,411 | B2 | 9/2012 | Py | |
| 8,459,312 | B2 | 6/2013 | Manera | |
| 8,511,492 | B2 * | 8/2013 | Webster | B65D 47/0833 215/44 |
| 8,783,483 | B2 * | 7/2014 | Faragher | B65D 50/046 220/254.5 |
| 9,156,569 | B2 | 10/2015 | Vassallo | |
| 9,296,531 | B2 | 3/2016 | Luzbetak | |
| 9,849,067 | B2 | 12/2017 | Vassallo | |
| 9,884,706 | B1 | 2/2018 | Skillin | |
| 10,058,481 | B1 | 8/2018 | Russo | |
| 10,689,169 | B1 | 6/2020 | Meshberg | |
| 11,242,185 | B2 | 2/2022 | Marantis | |
| 12,167,989 | B2 * | 12/2024 | Gift | A61J 1/1437 |
| 2003/0201283 | A1 * | 10/2003 | Branson | B65D 50/04 222/153.14 |
| 2004/0074919 | A1 | 4/2004 | Knickerbocker | |
| 2005/0133475 | A1 * | 6/2005 | Goto | B65D 50/046 215/237 |
| 2005/0178462 | A1 | 8/2005 | Py | |
| 2005/0205607 | A1 * | 9/2005 | Hierzer | B65D 47/0804 222/546 |
| 2006/0186077 | A1 | 8/2006 | Robinson | |
| 2007/0084524 | A1 | 4/2007 | Py | |
| 2007/0144996 | A1 * | 6/2007 | Sawyer | B65D 47/0809 215/221 |
| 2007/0214692 | A1 | 9/2007 | Ferrara | |
| 2008/0237278 | A1 | 10/2008 | Gaus | |
| 2009/0152269 | A1 * | 6/2009 | Pucci | B65D 55/024 220/254.3 |
| 2010/0063473 | A1 | 3/2010 | Schwarz | |
| 2010/0089861 | A1 | 4/2010 | Rutter | |
| 2010/0154245 | A1 | 6/2010 | Py | |
| 2010/0327010 | A1 | 12/2010 | Manera | |
| 2011/0168292 | A1 | 7/2011 | Luzbetak | |
| 2012/0103468 | A1 | 5/2012 | Terwilliger | |
| 2012/0103469 | A1 | 5/2012 | Terwilliger | |
| 2012/0103470 | A1 | 5/2012 | Terwilliger | |
| 2012/0104054 | A1 | 5/2012 | Terwilliger | |
| 2012/0211505 | A1 | 8/2012 | Vollers | |
| 2013/0102989 | A1 | 4/2013 | McCoy | |
| 2013/0160891 | A1 | 6/2013 | Vassallo | |
| 2013/0180618 | A1 | 7/2013 | Py | |
| 2013/0270273 | A1 * | 10/2013 | Fox | B65D 50/046 220/324 |
| 2014/0261860 | A1 | 9/2014 | Heath | |
| 2015/0112296 | A1 | 4/2015 | Ishiwata | |
| 2015/0209230 | A1 | 7/2015 | Lev | |
| 2016/0130049 | A1 | 5/2016 | Rogers | |
| 2017/0057711 | A1 * | 3/2017 | Miller | B65D 83/04 |
| 2018/0098913 | A1 | 4/2018 | Vassallo | |
| 2018/0207061 | A1 * | 7/2018 | Fox | B65D 47/0804 |
| 2019/0276201 | A1 * | 9/2019 | French | B65D 50/043 |
| 2021/0276769 | A1 * | 9/2021 | Dzurik | B65D 47/08 |
| 2023/0339658 | A1 * | 10/2023 | Gift | B65D 47/08 |

FOREIGN PATENT DOCUMENTS

| | | | |
|---|---|---|---|
| GB | 2513840 | A | 11/2014 |
| WO | 2007027567 | | 3/2007 |
| WO | 2008065879 | A1 | 6/2008 |
| WO | 2009133754 | A1 | 11/2009 |
| WO | 2013003293 | | 1/2013 |
| WO | 2018122019 | | 7/2018 |
| WO | 2019090079 | A1 | 5/2019 |
| WO | 2020131669 | A1 | 6/2020 |

OTHER PUBLICATIONS

Office Action dated Sep. 27, 2019 for U.S. Appl. No. 15/835,523 (pp. 1-8).

International (PCT) Search Report and Written Opinion for PCT/U.S. Pat. No. 2020020654 dated May 6, 2020, BP-542 PCT |, 10 pages.

International (PCT) Search Report and Written Opinion for PCT/US2020/020659 dated May 7, 2020, BP-544 PCT |, 10 pages.

International (PCT) Search Report and Written Opinion for PCT/US2020/020650 dated May 7, 2020, BP-540 PCT |, 16 pages.

Office Action dated Dec. 13, 2021 for U.S. Appl. No. 16/806,284, BP-540 US-U | (pp. 1-10).

Office Action (Non-Final Rejection) dated Feb. 18, 2022 for U.S. Appl. No. 16/806,462, BP-542 US-U |(pp. 1-9).

International (PCT) Search Report and Written Report for PCT/US22/42150 dated Nov. 23, 2022, BP-579 PCT |, 12 pages.

Indian First Examination Report for Indian Patent App. No. 202117040342 dated Jan. 12, 2023, BP-540 IN |, 6 pages.

European Search Report for European App. No. EP20766543.1 dated Jan. 24, 23, BP-540 EP |, 9 pages.

First Chinese Office Action for Chinese Patent App. No. 202080032881.9 dated Feb. 11, 2023, 14 pages.

International (PCT) Search Report and Written Opinion for PCT/US23/19233 dated Jul. 19, 2023, BP-585 PCT |, 9 pages.

European Search Report for European Patent App. No. EP23792521.9 dated Mar. 23, 26, BP-585 EP, 7 pages.

* cited by examiner

CHILD-RESISTANT CLOSURE

PRIORITY CLAIM

This application claims priority under 35 U.S.C. § 119(e) to U.S. Provisional Application Ser. No. 63/332,883, filed Apr. 20, 2022, which is expressly incorporated by reference herein.

BACKGROUND

The present disclosure relates to closures for securing on the top of a container, and in particular to a container closure including a flip-top cap. More particularly, the present disclosure relates to a child-resistant closure.

SUMMARY

According to the present disclosure, a closure includes a body that is adapted to mate with a container, a flip-top cap coupled to the body, and a hinge interconnecting the body and the flip-top cap. The body is configured to be mounted onto container to cover a discharge outlet formed in the container. The flip-top cap is configured to protect a product-dispensing spout formed on the body and block a child, for example, from accessing the product dispensing spout and removing contents from the container. The hinge is coupled between the body and the flip-top cap to provide a pivot point for the flip-top cap relative to the body. The hinge allows for pivoting movement of the flip-top cap relative to the body from a closed position on the body covering the product-dispensing spout to an opened position away from the body uncovering the product-dispensing spout.

In illustrative embodiments, the body includes an upper wall formed to include the product-dispensing spout, an inner wall, and an outer wall. The inner wall includes an interior mount rim that is appended to an inside surface of the inner wall and is adapted to mate with the discharge outlet formed on the container. The inner wall is arranged to extend axially away from the upper wall relative to a central axis of the body. The outer wall of child-resistant closure is cylinder-shaped in the illustrated embodiment and is appended to the upper wall. The outer wall is arranged to extend axially away from the upper wall relative to the central axis and is located radially outward of the inner wall relative to the central axis.

In illustrative embodiments, to open the closure, the flip-top cap can be squeezed by a user to deform first and second deformable tabs and thereby cause movement of first and second cap latches of the deformable tabs away from companion first and second body latches included in the body. Such latch disengagement releases the flip-top cap so that it can be pivoted on the hinge away from the body by a user that is aware of a cap-opening procedure to the opened position to expose the product-dispensing spout formed in the body.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 8 is a sectional view taken along line 6-6 of FIG. 1 showing the flip-top cap in a closed position on the body and showing a thumb and forefinger of a hand of the user about to apply a squeezing force on each deformable tab;

FIG. 9 is a sectional view similar to FIG. 8 showing inward movement and deformation of the first deformable tab to disengage the first cap latch on the flip-top cap and inward movement and deformation of the second deformable tab to disengage the second cap latch on the flip-top cap in response to opposing squeezing forces applied to each deformable tab by the thumb and forefinger, for example, which are used to release the flip-top cap from the closed position;

FIG. 10 is a sectional view similar to FIGS. 8 and 9 showing upward movement of the released flip-top cap away from the underlying body;

FIG. 11 is a sectional view similar to FIGS. 8-10 showing downward movement of the flip-top cap toward the closed position on the body to re-engage the first cap latch to the first body latch and to re-engage the second cap latch to the second body latch;

DETAILED DESCRIPTION

Figure 1:
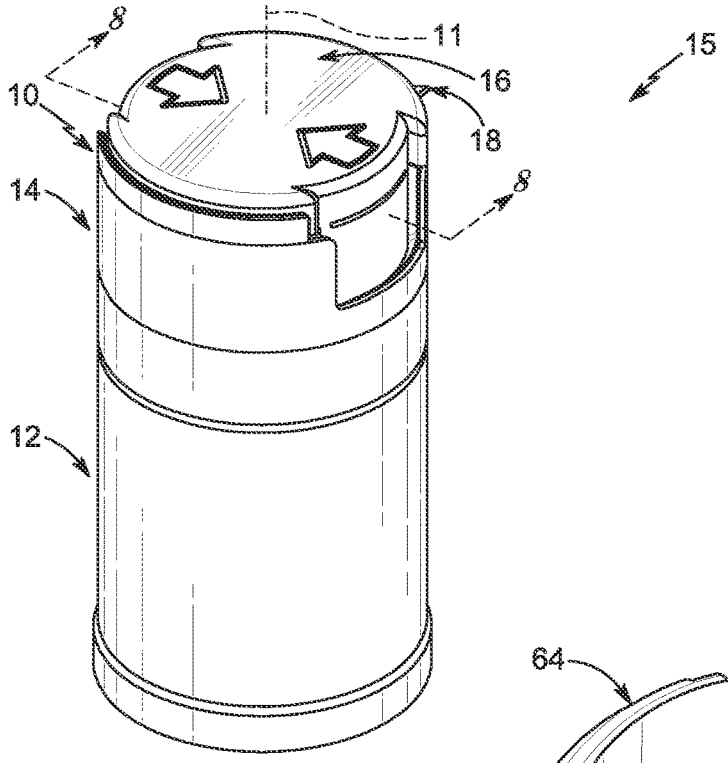
FIG. 1 is a perspective view of a child-resistant closure mounted on a container to cover a mouth opening into an interior region formed in the container and formed to include a flip-top cap retained in a closed position on an underlying body coupled to the container.
Figure 2:
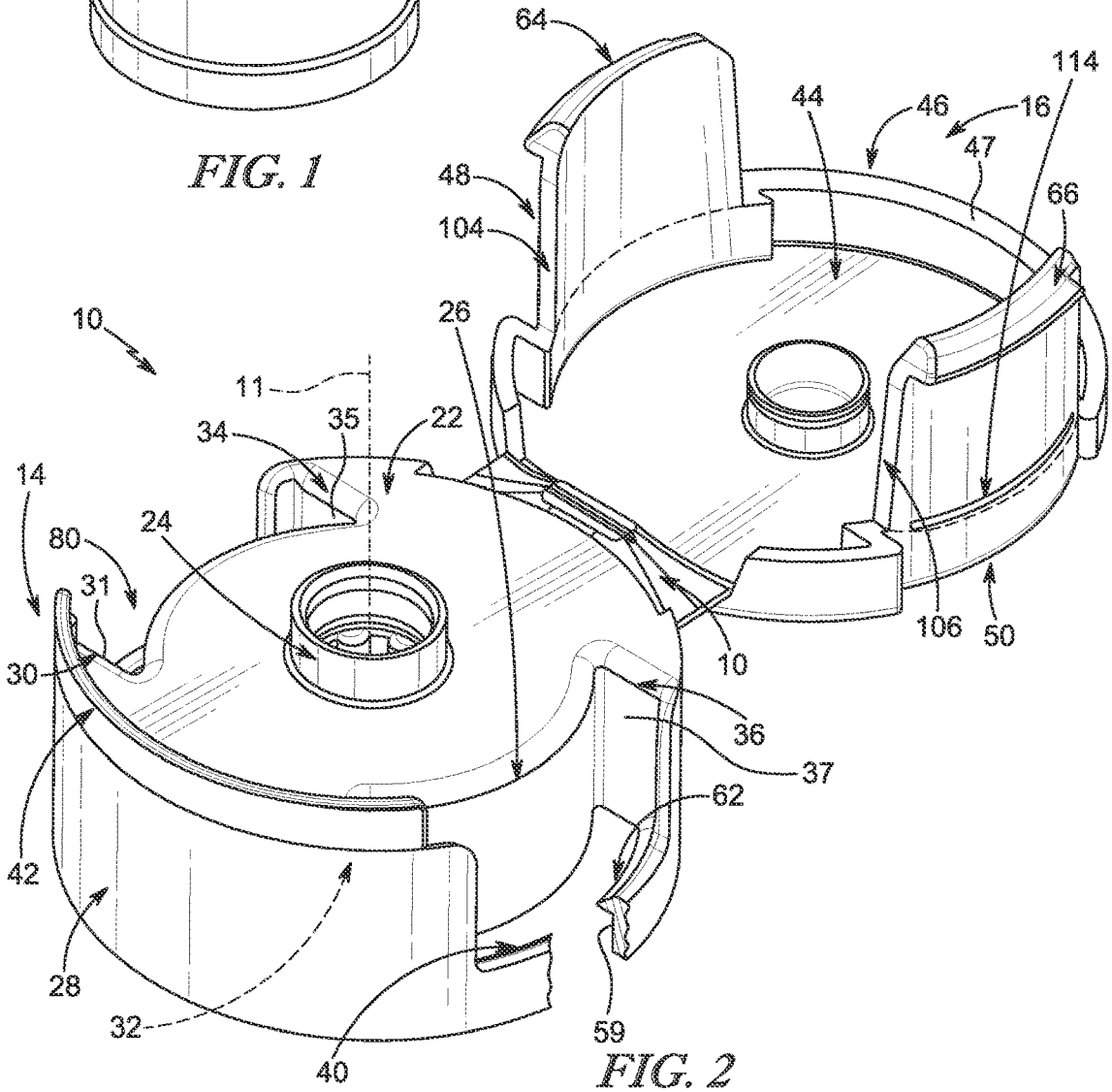
FIG. 2 is an enlarged perspective view of the closure of FIG. 1, with a portion broken away, after movement of the flip-top cap on a hinge relative to the body to an opened position exposing a product-dispensing spout formed in the body and showing the hinge interconnecting the body and the flip-top cap, two tab-receiving spaces included in the body and arranged in spaced-apart relation to one another, and two deformable tabs arranged in spaced-apart relation to one another on a bottom end of a side wall of the flip-top cap to provide child-resistant means for retaining the flip-top cap in the closed position on the closure body as suggested in FIG. 8.
Figure 3:
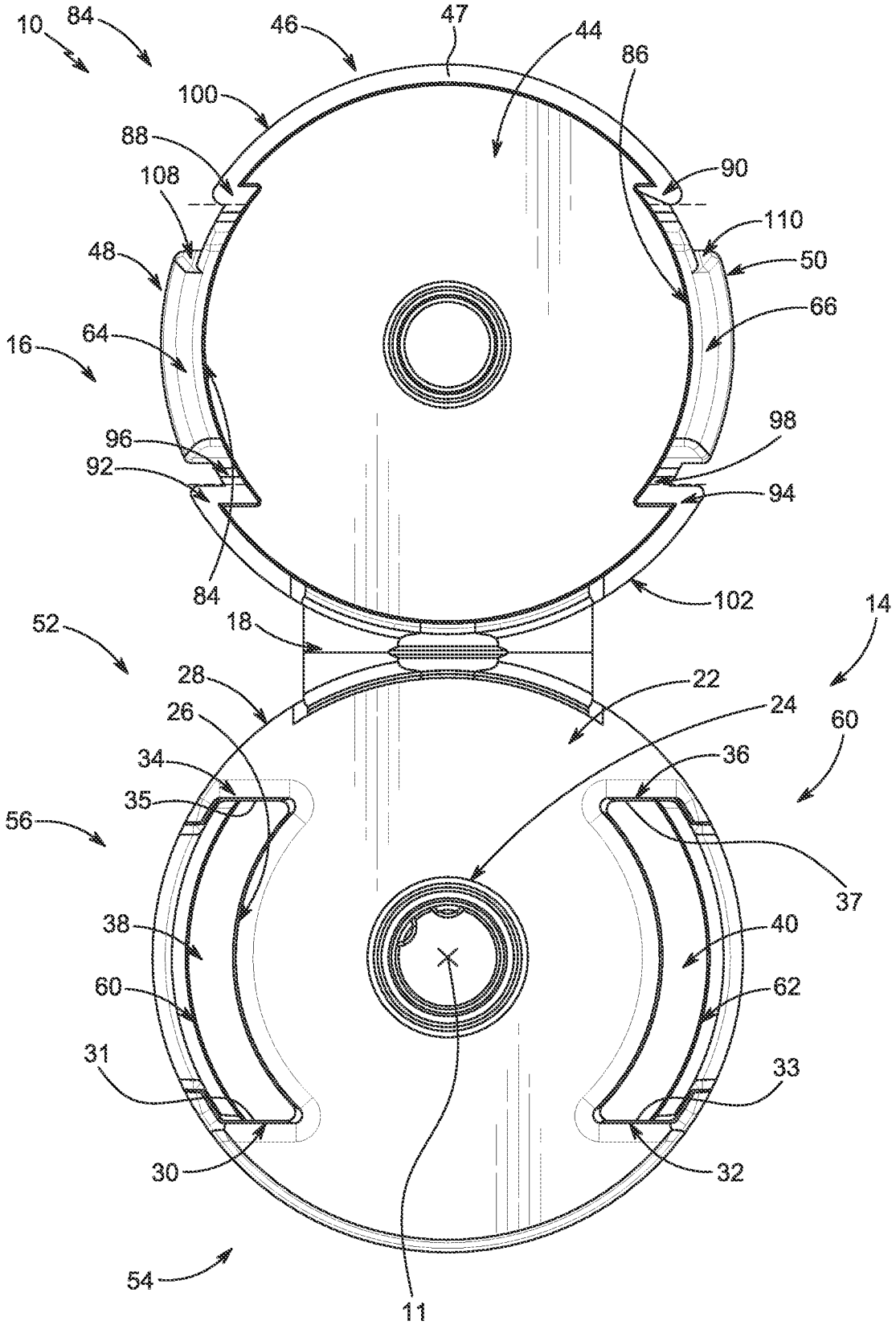
FIG. 3 is a top plan view of the closure of FIG. 2 showing a first tab-receiving space configured to receive a first deformable tab and a second tab-receiving space configured to receive a second deformable tab such that the a cap latch of the each deformable tab engages a companion body latch of an outer wall of the body when the flip-top cap is in the closed positon shown in FIG. 8.

A child-resistant closure 10 includes a body 14 that is adapted to mate with a container 12, a flip-top cap 16, and a hinge 18 interconnecting body 14 and flip-top cap 16 as shown, in an opened position in FIGS. 2 and 3. Closure 10 is adapted to be mounted on container 12 to form a child-resistant package 15 as suggested in FIGS. 1, 6, and 8-11. To open closure 10, flip-top cap 16 can be squeezed by a user as suggested in FIG. 9 to deform first and second deformable tabs 48, 50 and thereby cause movement of first and second cap latches 64, 66 of deformable tabs 48,50 away from companion first and second body latches 60, 62 included in body 14. Such latch disengagement releases flip-top cap 16, as suggested in FIG. 9, so that it can be pivoted on hinge 18 away from body 14 by a user that is aware of the cap-opening procedure to an opened position to expose a product-dispensing spout 24 formed in body 14 as shown in FIG. 2.

Body 14 is configured to be mounted onto container 12 as shown in FIG. 1. Flip-top cap 16 is configured to protect a product-dispensing spout 24 of the body 14 and prevent a child, for example, from accessing product dispensing spout 24 and removing contents from container 12. Hinge 18 is coupled between body 14 and flip-top cap 16 to provide a pivot point for flip-top cap 16 relative to body 14. Hinge 18 allows for pivoting movement of flip-top cap 16 relative to body 14 from the closed position on body 14 covering product-dispensing spout 24, as shown, for example, in FIGS. 1 and 8, to the opened position away from body 14 uncovering product-dispensing spout 24, as shown, for example, in FIG. 2. In some embodiments, hinge 18 is a living hinge and cooperates with body 14 and flip-top cap 16 to form a monolithic closure 10.

Body 14 includes an upper wall 22 formed to include a product-dispensing spout 24, an inner wall 26, an outer wall 28, first and second front wall supports 30, 32, and first and second rear wall supports 34, 36. Inner wall 26 includes an interior mount rim 25 that is appended to an inside surface 27 of inner wall 26 and is adapted to mate with a discharge outlet 20 formed on a container 12, as shown, for example, in FIG. 1. Inner wall 26 is arranged to extend axially away from upper wall 22 relative to a central axis 11 of body 14. Outer wall 28 of child-resistant closure 10 is cylinder-shaped in the illustrated embodiment and is appended to upper wall 22. Outer wall 28 is arranged to extend axially away from upper wall 22 relative to central axis 11 and is located radially outward of inner wall 26 relative to central axis 11.

Front wall supports 30, 32 and rear wall supports 34, 36 are configured to reinforce outer wall 28 with inner wall 26 as shown in FIG. 3. First and second front wall supports 30, 32 are appended to upper wall 22, are arranged to extend downwardly away from upper wall 22 relative to central axis 11 and extend radially between inner wall 26 and outer wall 28 relative to central axis 11. Likewise, first and second rear wall supports 34, 36 are appended to upper wall 22, are arranged to extend downwardly away from upper wall 22 relative to central axis 11 and extend radially between inner wall 26 and outer wall 28 relative to central axis 11. A space-facing surface 31 of first front wall support 30 is arranged to face a space-facing surface 35 of first rear wall support 34, and a space-facing surface 33 of second front wall support 32 is arranged to face a space-facing surface 37 of second rear wall support 36. Front wall supports 30, 32 and rear wall supports 34, 36 are optional and may be omitted in some embodiments.

Inner wall 26 and outer wall 28 cooperate to define a first tab-receiving space 38 and a second tab-receiving space 40 in body 14 as shown in FIGS. 2 and 3. First tab-receiving space 38 is located radially between inner wall 26 and outer wall 28 relative to central axis 11. Likewise, second tab-receiving space 40 is located radially between inner wall 26 and outer wall 28. First tab-receiving space 38 may also be defined circumferentially between first front wall support 30 and first rear wall support 34. Second tab-receiving space 40 may be defined circumferentially between second front wall support 32 and second rear wall support 36.

Outer wall 28 includes a hinge segment 52, a front wall segment 54, a first latch-support segment 56, and a second latch-support segment 58. Hinge segment 52 separates and interconnects first latch-support segment 56 from second latch-support segment 58. Hinge segment 52 also extends circumferentially between first rear wall support 34 and second rear wall support 36 relative to central axis 11. Front wall segment 54 separates and interconnects first latch-support segment 56 from second latch-support segment 58. Front wall segment 54 extends circumferentially between first front wall support 30 and second front wall support 32 relative to central axis 11. First latch-support segment 56 extends circumferentially between first rear wall support 34 and first front wall support 30 relative to central axis 11. Second latch-support segment 58 extends circumferentially between second rear wall support 36 and second front wall support 34 relative to central axis 11.

Figure 4:
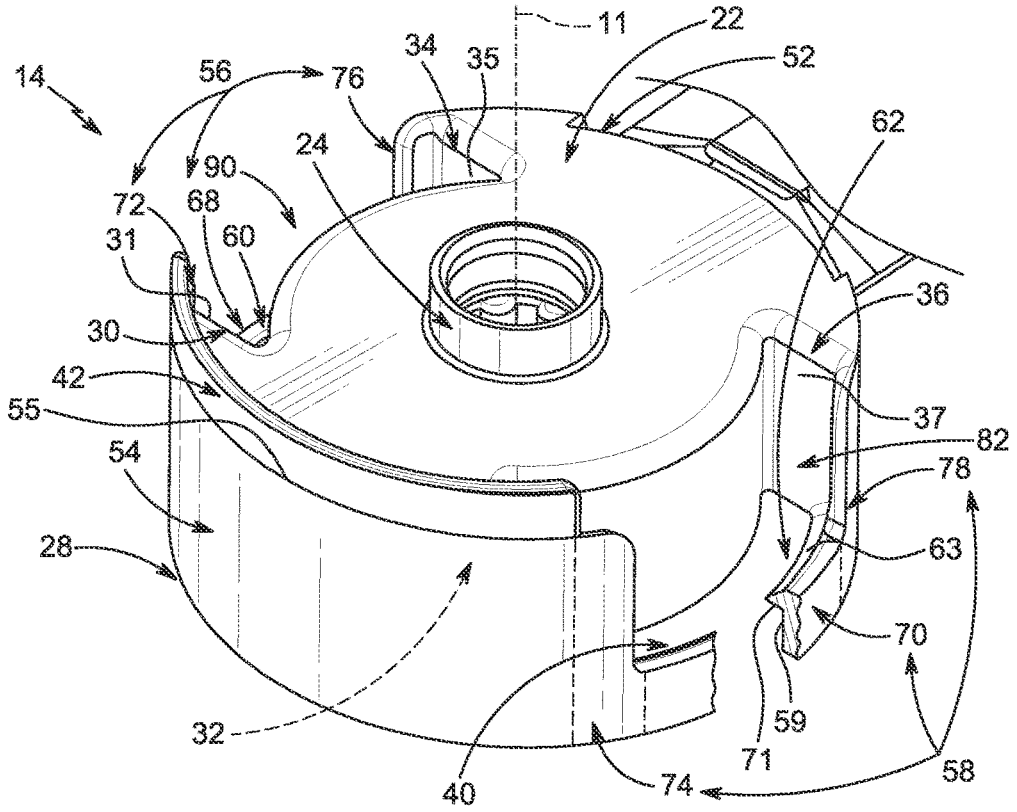
FIG. 4 is an enlarged perspective view of the body of the closure shown in FIGS. 2 and 3 showing that the body includes an outer wall and a first body latch extending radially inward from the outer wall, the first body latch configured to engage a cap latch of the flip top cap in the closed position to retain the flip-top cap in the closed position.
Figure 5:
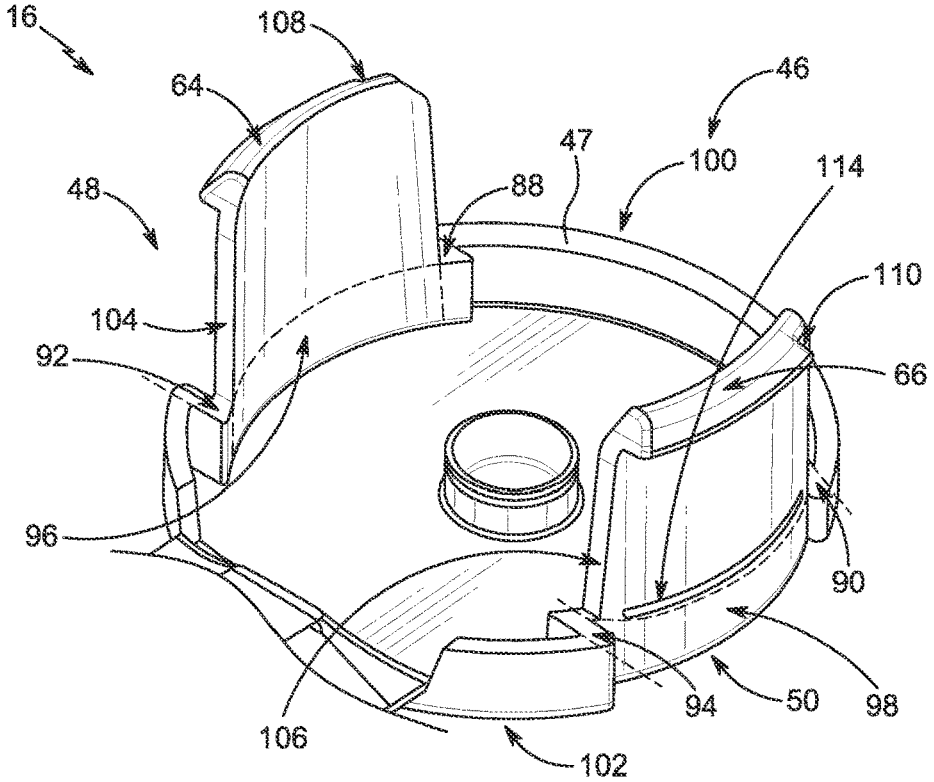
FIG. 5 is an enlarged perspective view of the flip-top cap of FIGS. 2 and 3 showing the first deformable tab and the second deformable tab each located on opposite sides of the side wall from one another.
Figure 8:
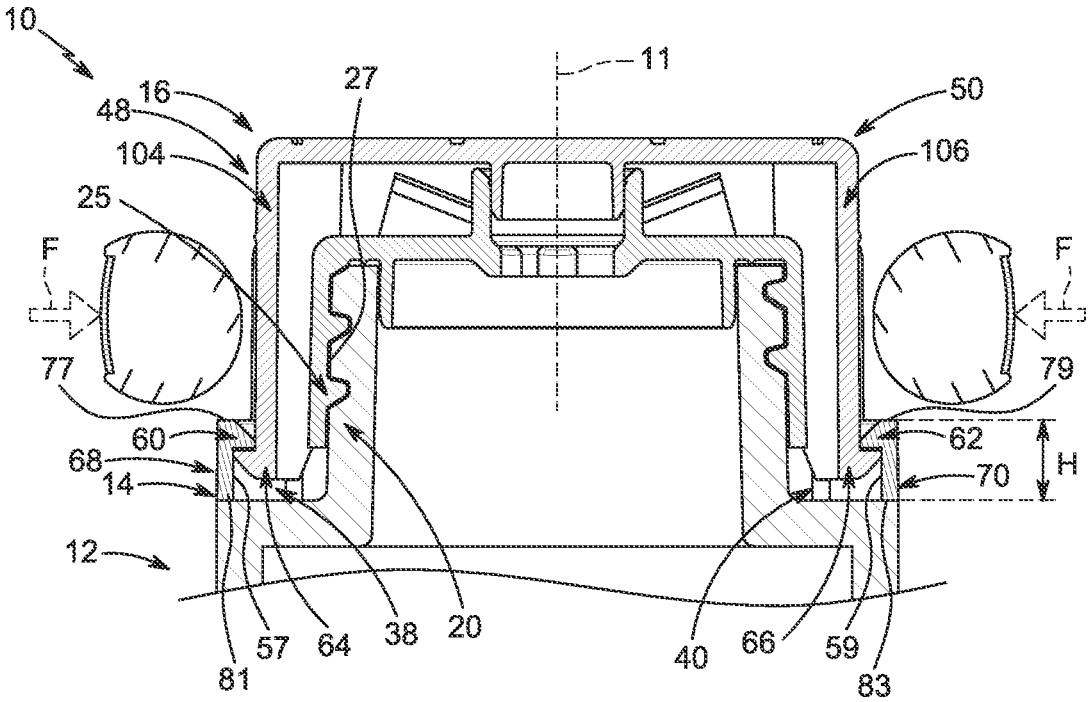
FIGS. 8-11 show an opening sequence for the flip-top cap of the closure shown in FIGS. 1-6.
Figure 10:
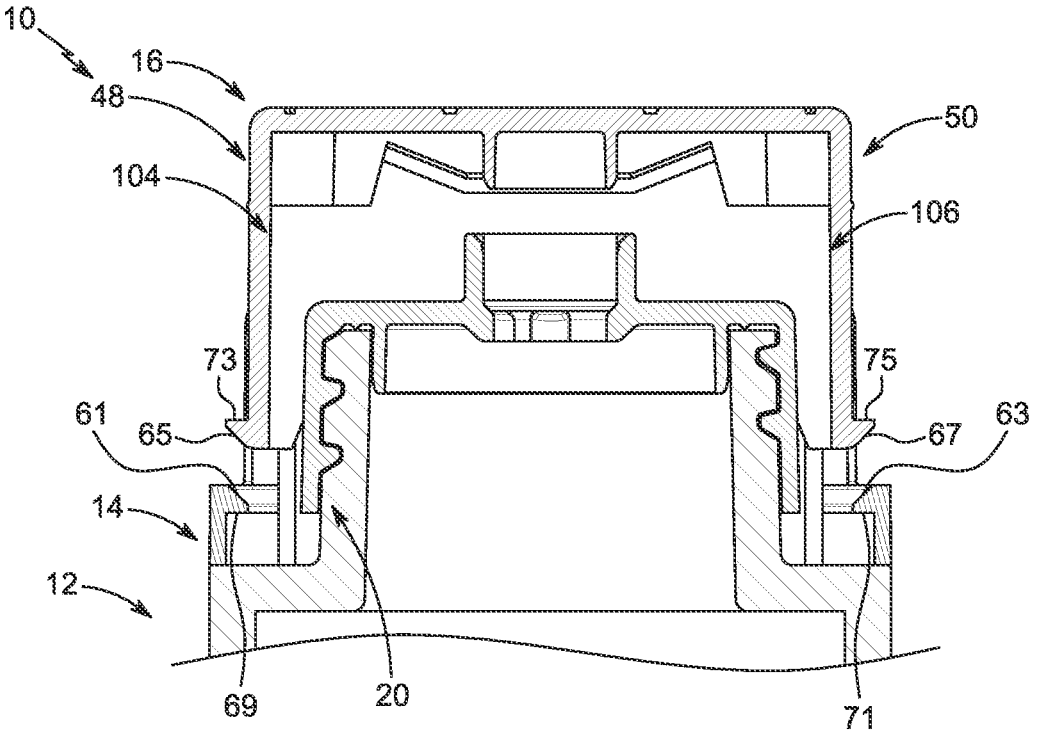

Both first latch-support segment 56 and second latch-support segment 58 each include a body latch 60, 62 extending radially inward from an inner surface 57, 59 of first and second latch-support segments 56, 58, as shown in FIGS. 4 and 10. Body latch 60 also extends circumferentially between first rear wall support 34 and first front wall support 30, while body latch 62 extends circumferentially between second rear wall support 36 and second front wall support 32. Each body latch 60, 62 is configured to engage a companion cap latch 64, 66 of first and second deformable tabs 48, 50, as shown in FIG. 8.

Figure 11:
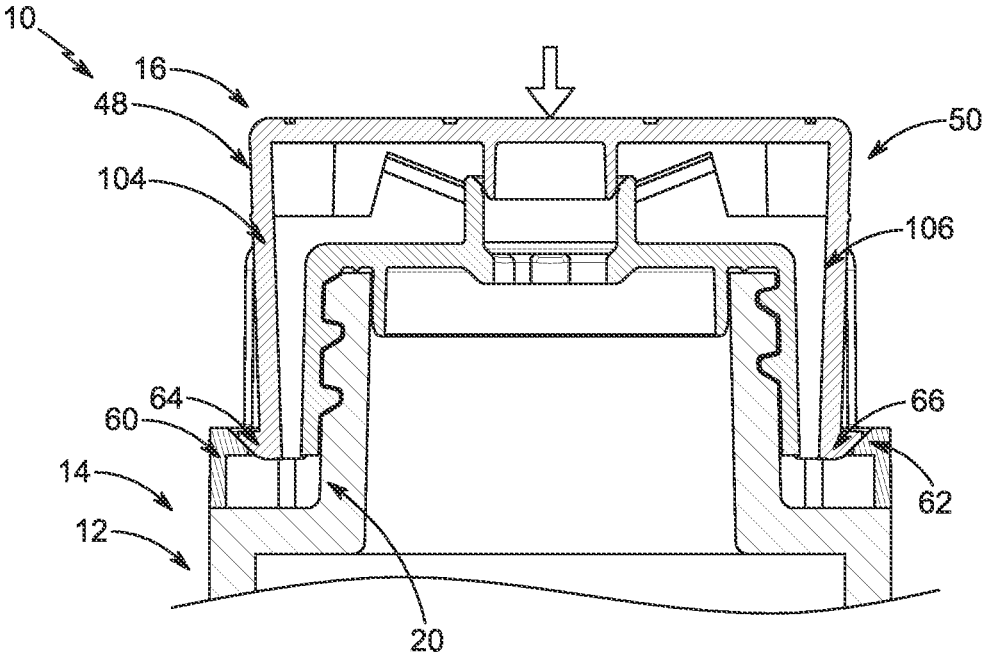

Body latches 60, 62 each include a downwardly-angled upper surface 61, 63 configured to engage a companion upwardly-angled lower surface 65, 67 of cap latches 64, 66 when the flip-tip cap 16 is moved from the open position to the closed position, as shown in FIG. 11. Furthermore, body latches 60, 62 each include a lower surface 69, 71 that engages a companion upper surface 73, 75 of each cap latch 64, 66 when the flip-top cap 16 is in the closed position, as shown in FIG. 8.

First latch-support segment 56 and second latch-support segment 58 of the outer wall 28 each include a latch-support panel 68, 70 extending circumferentially between a first circumferential-gap cover 72, and a second circumferential-gap cover 76, 78 as shown in FIGS. 2-4. First circumferential-gap covers 72, 74 each extend circumferentially from front wall segment 54 to latch-support panel 68, 70, while second circumferential-gap covers 76, 78 each extend circumferentially from hinge segment 52 to latch-support panels 68, 70. Latch-support panels 68, 70, first circumferential-gap covers 72, 74, and second circumferential-gap covers 76, 78 cooperate to define finger-receiving spaces 80, 82 located axially above latch-support panels 68, 70 and circumferentially between respective circumferential gap-covers 72, 74, 76, 78 relative to central axis 11. When flip-top cap 16 is in the closed position, first deformable tab 48 and second deformable tab 50 are each located radially inward of outer wall 28 and circumferentially extend between first circumferential-gap covers 72, 74 and second circumferential-gap covers 76, 78 to minimize gaps between outer wall 28 and deformable tabs 48, 50.

Figure 7:
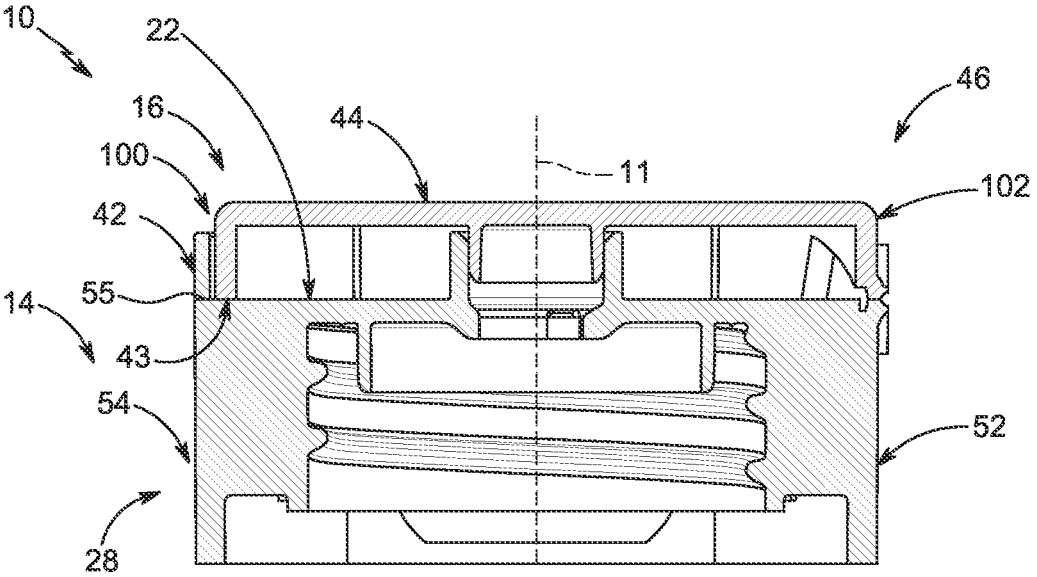
FIG. 7 is a sectional view taking along line 7-7 of FIG. 6 (without the container) showing an upwardly extending lip that is flush with an outside surface of the outer wall and showing an inside lip surface of the upwardly extending lip that is in confronting relation to an outside surface of the side wall of the flip top cap.
Figure 14:
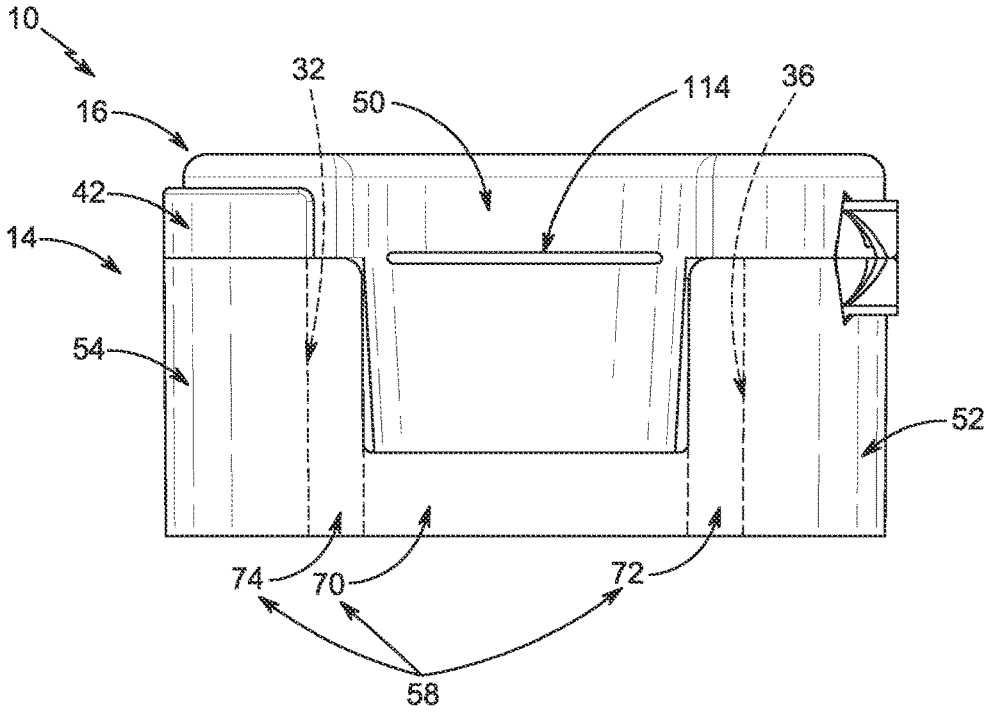
FIG. 14 is a side view similar to FIGS. 12 and 13 showing the flip-top cap in the closed position.

Flip-top cap 16 includes a top wall 44, a side wall 46, a first deformable tab 48, and a second deformable tab 50, as shown, for example, in FIG. 2. Side wall 46 is appended to top wall 44 and extends axially away from top wall 44 relative to central axis 11 when flip-top cap 16 is in the closed position, as shown in FIGS. 7 and 14. First deformable tab 48 and second deformable tab 50 are each coupled to a bottom end 47 of side wall 46. First deformable tab 48 is aligned with and received in first tab-receiving space 38 when flip-top cap 16 is in the closed position. Likewise, second deformable tab 50 is aligned with and received in second tab-receiving space 40 when flip-top cap 16 is in the closed position.

Side wall 46 of flip-top cap 16 includes a front side wall segment 100, a rear side wall segment 102, and opposing first and second tab-support segments 84, 86 as shown in FIG. 3. Front side wall segment 100 extends circumferentially about axis 11 along a front end of body 14 in the closed position. Rear side wall segment 102 extends circumferentially about axis 11 along a rear end of body 14 opposite the front end and adjacent to hinge 18 in the closed position. First and second tab-support segments 84, 86 extend between and interconnect front and rear side wall segments 100, 102 and support and locate first and second deformable tabs 48, 50 relative to tab-receiving spaces 38, 40 and body latches 60, 62.

First and second tab-support segments 84, 86 each include a first radially-extending segment 88, 90, a second radially-extending segment 92, 94, spaced apart from the first radially-extending segment 88, 90, and a circumferentially-extending segment 96, 98 extending between and interconnecting each respective first and second radially-extending segment 88, 90, 92, 94 as shown in FIG. 3. The first and second radially-extending segments 88, 90, 92, 94 extend inwardly away from the front and rear side wall segments 100, 102. First and second deformable tabs 48, 50 are coupled to bottom surface 47 of a respective one of first and second circumferentially-extending segments 96, 98. Circumferentially-extending segments 96, 98 are coupled to radially inner ends of respective first and second radially-extending segments 88, 90, 92, 94 to position the circumferentially-extending segments 96, 98 and first and second deformable tabs 48, 50 radially inward of front and rear side wall segments 100, 102 and latch-support panels 68, 70. Circumferentially-extending segments 96, 98 also position cap latches 64, 66 directly in line with body latches 60, 62 so that cap latches 64, 66 interlock with body latches 60, 62 when flip-top cap 16 is moved to the closed position.

Figure 9:
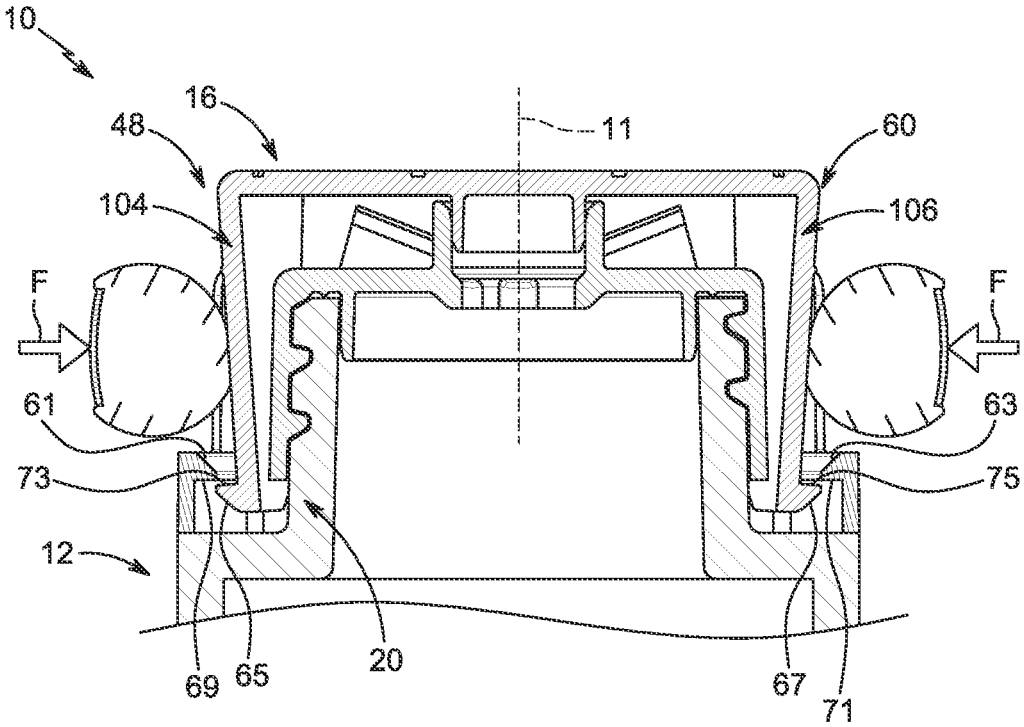

First and second deformable tabs 48, 50 each include a tab panel 104, 106 and a cap latch 64, 66 fixed to a radially outer surface of a respective tab panel 104, 106 as shown in FIGS. 8-10. Each tab panel 104, 106 is coupled to a respective one of the circumferentially-extending segments 96, 98. Cap latches 64, 66 are coupled to a lowermost, distal end of tab panels 104, 106 spaced apart from side wall 46.

Flip-top cap 16 may be removed from body 14 from the closed position to the opened position by applying a squeezing force F, with a thumb and a finger, for example, on both deformable tabs 48, 50 at the same time as suggested in FIGS. 8 and 9. Squeezing force F flexes deformable tabs 48, 50 and/or side wall 46 and causes cap latches 64, 66 to move away from body latches 60, 62 and closer to inner wall 26. Once cap latches 64, 66 are substantially and/or completely disengaged from body latches 60, 62, as shown in FIG. 9, flip-top cap 16 may be lifted away from body 14, as shown in FIG. 10, to the opened position. Each deformable tab 48, 50 may further include a finger grip 112, 114 formed on a radially outer surface of latch-support panels 68, 70 to increase grip for the user's fingers when opening flip-top cap 16.

Closure 10 is configured to automatically lock upon arrival at the closed position. As flip-top cap 16 is closed, upper surfaces 61, 63 of body latches 60, 62 eventually contact lower surfaces 65, 67 of cap latches 64, 66 as shown in FIG. 11. Contact between these surfaces 61, 63, 65, 67 causes deformable tabs 48, 50 to flex inwardly until upper surfaces 73, 75 of cap latches 64, 66 are located below lower surfaces 69, 71 of body latches 60, 62. The elasticity of deformable tabs 48, 50 returns them to an at least partially undeformed position where lower surfaces 69, 71 engage upper surfaces 73, 75 to block opening of flip-top cap 16.

Latch-support panels 68, 70 each have a height H that is defined between an upper surface 77, 79 and lower surface 81, 83 of each latch-support panel as shown in FIG. 8. Tab panels 104, 106 have a height from side wall 46 that extends deformable tabs 48, 50 downward along a majority of a height of outer wall 28 and past a lower end of inner wall 26 to body latches 60, 62. Coupling deformable tabs 48, 50 to flip-top cap 16, instead of body 14, for example, allows the height of deformable tabs 48, 50 to be increased, thereby allowing deformable tabs 48, 50 to flex a greater distance when subjected to squeezing force F. Because of this increased flexing distance without increased force F required to reach the increased flexing distance provided by tabs 48, 50, latches 60, 62, 64, and 66 can be sized with a greater radial thickness, thereby providing a more secure child-resistant closure 10. Increasing the height of deformable tabs may also provide a user aware of the opening procedure with greater mechanical advantage to apply the squeezing force F, thereby facilitating opening of the flip-top cap 16.

Figure 12:
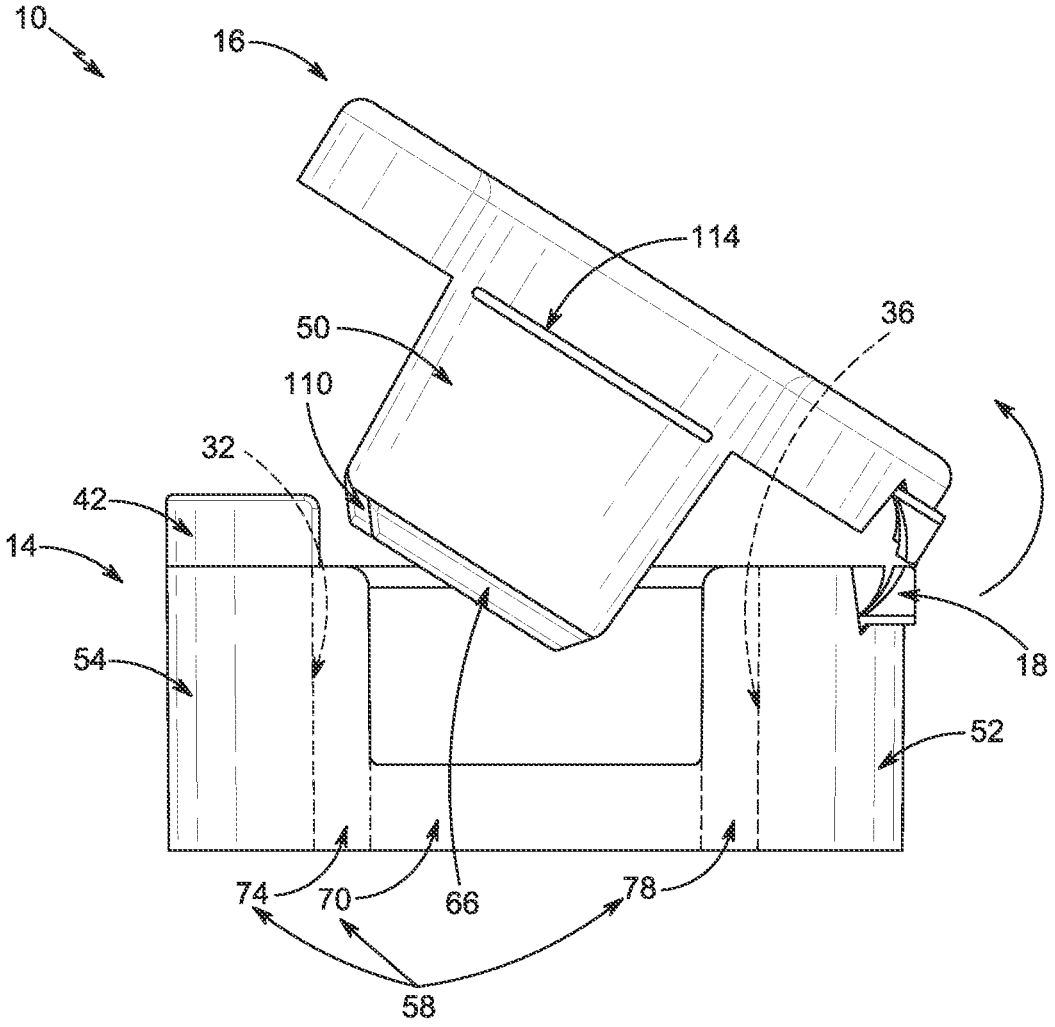
FIG. 12 is a side view of the closure of FIG. 1 in the opened position showing the first deformable tab removed from a first finger receiving slot defined by portions of the outer wall.
Figure 13:
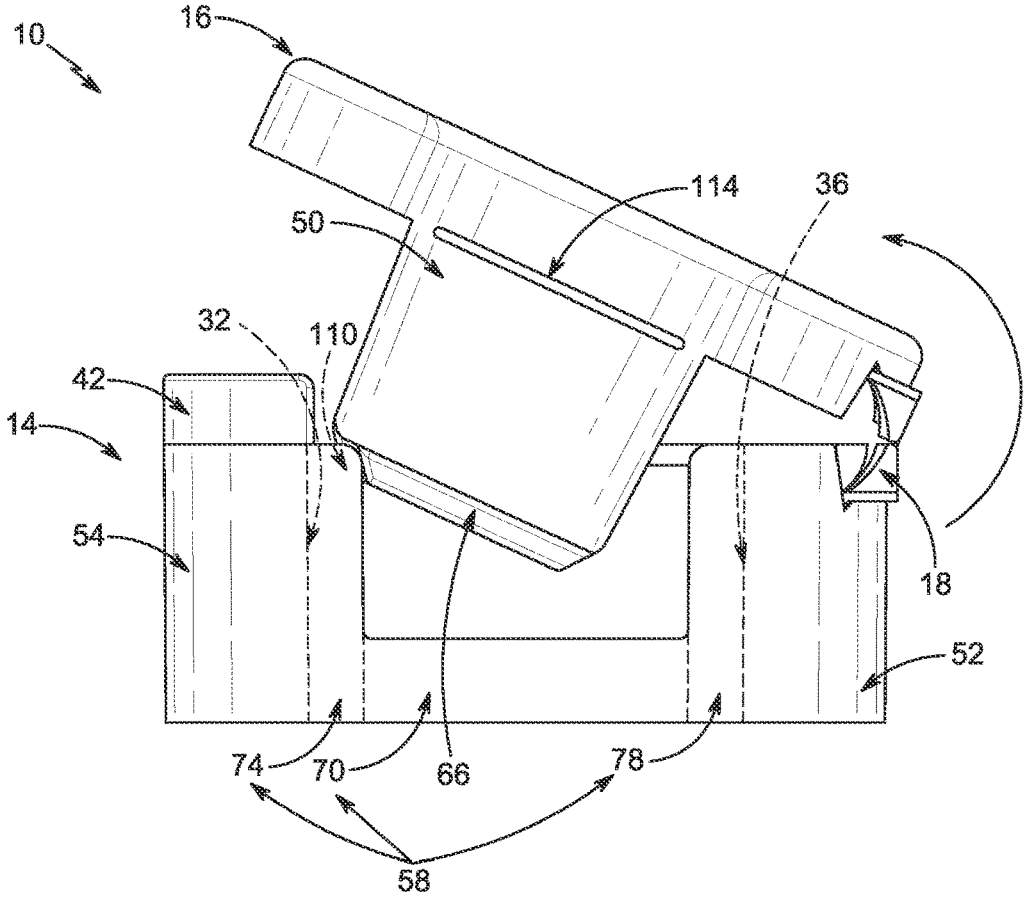
FIG. 13 is a side view similar to FIG. 12 showing downward movement of the flip-top cap toward the closed position on the body and showing that the deformable tab is structure to not engage with any portion of the outer wall of the body until the flip-top cap is moved toward the closed position when the tab latch engages with the body latch.

Deformable tabs 48, 50 are structured to minimize interference with portions of outer wall 28 when moving between the opened and closed positions while also minimizing access to interfaces between body 14 and flip-top cap 16 as shown in FIGS. 12-14. Each deformable tab 48, 50 is formed to include a clearance space 108, 110 located at a forward end of cap latches 64, 66. Cap latches 64, 66 have a circumferential length that is less than a circumferential length of latch-support panels 68, 70 to provide clearance spaces 108, 110. Clearance spaces 108, 110 allow deformable tabs to move past gap covers 72, 74 as flip-top cap 16 is opened or closed so that cap latches 64, 66 do not contact gap covers 72, 74 as suggested in FIG. 13. The greater circumferential length of latch-support panels 68, 70 minimizes spacing between gap covers 72, 74 and latch-support panels 68, 70 to reduce areas where an object, such as a fingernail, can be wedged therebetween and used to pry open flip-top cap 16.

Figure 6:
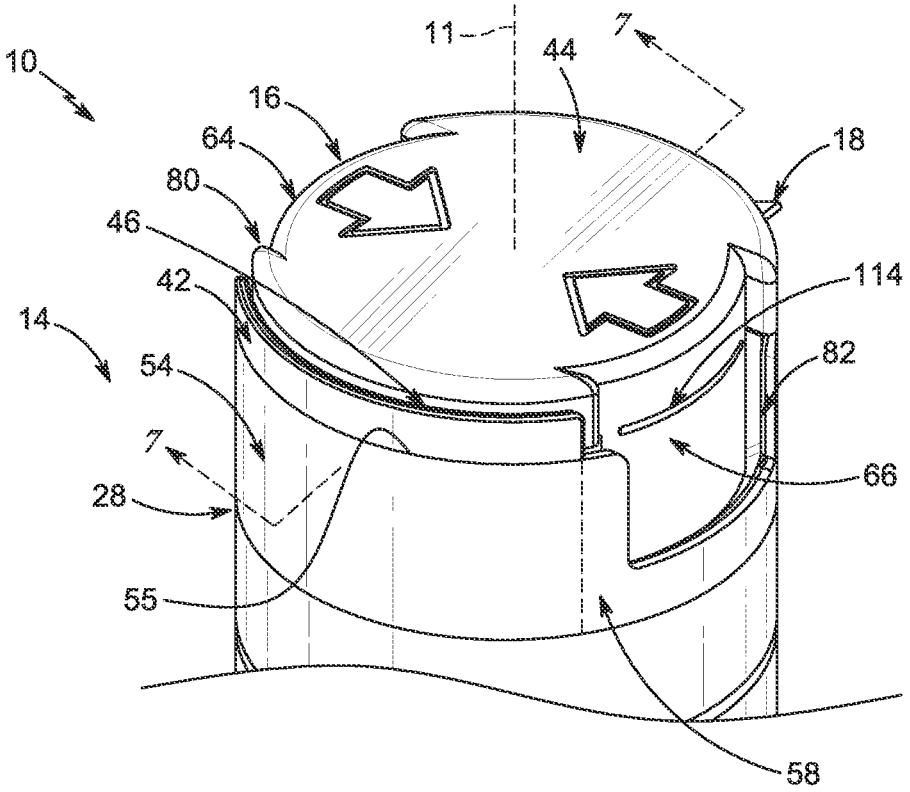
FIG. 6 is an enlarged perspective view of the closure of FIG. 1 showing the flip-top cap in the closed position.

Body 18 may further include an upwardly extending lip 42, as shown in FIGS. 6-7. Upwardly extending lip 42 is coupled to an upper end 55 of front wall segment 54 of outer wall 28 and extends upwardly away from upper wall 22 relative to central axis 11. Upwardly extending lip 42 also extends circumferentially about front wall segment 54 between first latch-support segment 56 and second latch-support segment 56. When flip-top cap 16 is in the closed position, upwardly extending lip 42 blocks access to an interface 43 between side wall 46 of flip-top cap 16 and upper wall 22 of body 14. Thus, a finger or finger nail of a child, for example, cannot slide between side wall 46 and upper wall 22 and remove flip top cap 16 from body 14 for unauthorized access to the product-dispensing spout 24. An upper end of upwardly extending lip 42 is located above the interface 43 when flip-top cap 16 is in the closed position to block access to interface 43 at least along front wall segment 54 between first and second deformable tabs 48, 50. Forming deformable tabs 48, 50 on flip-top cap 16 also minimizes a circumferential area where interface 43 is formed between flip-top cap 16 and body 14 thereby minimizing areas where an object can be wedged therebetween and used to pry open flip-top cap 16.

The invention claimed is:

1. A child-resistant closure comprising a body including an upper wall formed to include a product-dispensing spout, an inner wall appended to the upper wall and arranged to extend axially away from upper wall relative to a central axis of the body, wherein the inner wall includes an interior mount rim appended to an inside surface of the interior wall and adapted to mate with a discharge outlet formed on a container, and an outer wall appended to the upper wall and arranged to extend axially away from the upper wall relative to the central axis, wherein the outer wall is located radially outward of the inner wall relative to the central axis, and wherein the inner wall and the outer wall cooperate to define a first tab-receiving space located radially between the outer wall and the inner wall relative to the central axis and a second tab-receiving space located radially between the outer wall and the inner wall relative to the central axis, a flip-top cap including a top wall, a side wall coupled to the top wall and arranged to extend axially away from the top wall, a first deformable tab coupled to a bottom end of the side wall and aligned with the first tab-receiving space, and a second deformable tab coupled to the bottom end of the side wall and aligned with the second tab-receiving space, and a hinge coupled between the body and the flip-top cap to support the flip-top cap for movement relative to the body from a closed position on the body covering the product-dispensing spout to an open position away from the body uncovering the product dispensing spout, wherein each deformable tab includes a cap latch extending radially outward from the deformable tab and arranged to engage a corresponding body latch extending radially inward from an inside surface of the outer wall in the closed position, and wherein the cap latch disengages the body latch upon deformation of each deformable tab so that the flip-top cap is movable from the closed position to the open position, wherein the body further includes first and second front wall supports and first and second rear wall supports that each extend radially relative to the central axis to interconnect the inner wall and the outer wall and to define the first tab-receiving space circumferentially between the first front wall support and the first rear wall support and the second tab-receiving space circumferentially between the second front wall support and the second rear wall support, wherein the first and second front wall supports are appended to the upper wall and are arranged to extend downwardly away from the upper wall relative to the central axis from an upper end at a lower surface of the upper wall to a lower end at a lower end of the inner wall, wherein the first and second rear wall supports are appended to the upper wall and are arranged to extend downwardly away from the upper wall relative to the central axis from an upper end at the lower surface of the upper wall to a lower end at the lower end of the inner wall, and wherein each deformable tab includes a tab panel, wherein each tab panel has a height that extends each corresponding deformable tab downward along a majority of a height of the outer wall and past a lower end of the inner wall to each corresponding body latch when the flip-top cap is in the closed position.

2. The child-resistant closure of claim 1, wherein the first deformable tab is coupled to a first portion of the bottom end of the side wall, the second deformable tab is coupled to a second portion of the bottom end of the side wall, wherein the first portion of the bottom end of the side wall and the second portion of the bottom end of the side wall are each radially inward relative to the central axis of a third portion of the bottom end of the side wall and a fourth portion of the bottom end of the side wall, and wherein the first deformable tab and the second deformable tab each extend axially away from the side wall relative to the central axis.

3. The child-resistant closure of claim 2, wherein the first deformable tab is arranged to lie in spaced-apart, opposing relation to the second deformable tab relative to the central axis such that a central point of the first deformable tab is about 180° from the a central point of the second deformable tab.

4. The child-resistant closure of claim 1, wherein the cap latch of the first deformable tab is spaced a first distance from the inner wall when the flip-top cap is in the closed position and the cap latch of the second deformable tab is spaced a second distance from the inner wall when the flip-top cap is in the closed position, wherein the cap latch of the first deformable tab is spaced a third distance from the inner wall upon application of a first force to the first deformable tab and the cap latch of the second deformable tab is spaced a fourth distance from the inner wall upon application of a second force to the second deformable tab, and wherein the third distance is smaller than the first distance and the fourth distance is smaller than the second distance.

5. The child-resistant closure of claim 4, wherein the first distance is equal to the second distance.

6. The child-resistant closure of claim 1, wherein the outer wall includes a front wall segment, a rear wall segment, a first tab-receiving space segment, and a second tab-receiving space segment, and wherein the first tab-receiving space segment is separated from the second tab-receiving space segment by at least one of the front wall segment and the rear wall segment.

7. The child-resistant closure of claim 6, wherein the body includes an upwardly extending lip that extends axially away from the front wall segment relative to the central axis and that includes a distal, upper end arranged to lie above an interface between the flip-top cap and the body to block access to the interface.

8. The child-resistant closure of claim 1, wherein the outer wall includes a front wall segment, a rear wall segment, a first latch-support segment, and a second latch-support segment, wherein each body latch includes an upper edge, and wherein the upper edge is configured to guide the cap latch of each corresponding deformable tab as the flip-top cap is moved from the open position to the closed position to cause deformation of each deformable tab so that an upper surface of each cap latch engages a lower surface of each body latch when the flip-top cap reaches the closed position.

9. The child-resistant closure of claim 1, wherein each body latch is coupled to a latch-support panel included in the outer wall of the body, and the cap latch is located above a lower end of each corresponding latch-support panel such that each corresponding latch-support panel overlies each corresponding cap latch to block access to each corresponding cap latch when the flip-top cap is in the closed position.

10. A child-resistant package comprising a container including a discharge outlet, and a child-resistant closure including:

a body including an upper wall formed to include a product-dispensing spout, an inner wall appended to the upper wall and arranged to extend axially away from upper wall, wherein the inner wall includes an interior mount rim appended to an inside surface of the interior wall and adapted to mate with the discharge outlet formed on the container, and an outer wall appended to the upper wall and arranged to extend axially away from the upper wall relative to a central axis of the body, wherein the outer wall is located radially outward of the inner wall relative to the central axis, and wherein the inner wall and the outer wall cooperate to define a first tab-receiving space located radially between the outer wall and the inner wall relative to the central axis and a second tab-receiving space located radially between the outer wall and the inner wall relative to the central axis, a flip-top cap including a top wall, a side wall coupled to the top wall and arranged to extend axially away from the top wall, a first deformable tab coupled to a bottom end of the side wall and aligned with the first tab-receiving space, and a second deformable tab coupled to the bottom end of the side wall and aligned with the second tab-receiving space, and a hinge coupled between the body and the flip-top cap to support the flip-top cap for movement relative to the body from a closed position on the body covering the product-dispensing spout to an open position away from the body uncovering the product dispensing spout, wherein each deformable tab includes a cap latch extending radially outward from the deformable tab and arranged to engage a corresponding body latch extending radially inward from an inside surface of the outer wall in the closed position, and wherein the cap latch disengages the body latch upon deformation of each deformable tab so that the flip-top cap is movable from the closed position to the open position, wherein the body further includes first and second front wall supports and first and second rear wall supports that each extend radially relative to the central axis to interconnect the inner wall and the outer wall and to define the first tab-receiving space circumferentially between the first front wall support and the first rear wall support and the second tab-receiving space circumferentially between the second front wall support and the second rear wall support, wherein the first and second front wall supports are appended to the upper wall and are arranged to extend downwardly away from the upper wall relative to the central axis from an upper end at a lower surface of the upper wall to a lower end at a lower end of the inner wall, wherein the first and second rear wall supports are appended to the upper wall and are arranged to extend downwardly away from the upper wall relative to the central axis from an upper end at the lower surface of the upper wall to a lower end at the lower end of the inner wall, and wherein each deformable tab includes a tab panel, wherein each tab panel has a height that extends each corresponding deformable tab downward along a majority of a height of the outer wall and past a lower end of the inner wall to each corresponding body latch when the flip-top cap is in the closed position.

11. The child-resistant package of claim 10, wherein the first deformable tab is coupled to a first portion of the bottom end of the side wall, the second deformable tab is coupled to a second portion of the bottom end of the side wall, wherein the first portion of the bottom end of the side wall and the second portion of the bottom end of the side wall are each radially inward relative to the central axis of a third portion of the bottom end of the side wall and a fourth portion of the bottom end of the side wall, and wherein the first deformable tab and the second deformable tab each extend axially away from the side wall relative to the central axis.

12. The child-resistant package of claim 11, wherein the first deformable tab is arranged to lie in spaced-apart, opposing relation to the second deformable tab relative to the central axis such that a central point of the first deformable tab is about 180° from the a central point of the second deformable tab.

13. The child-resistant package of claim 10, wherein the cap latch of the first deformable tab is spaced a first distance from the inner wall when the flip-top cap is in the closed position and the cap latch of the second deformable tab is spaced a second distance from the inner wall when the flip-top cap is in the closed position, wherein the cap latch of the first deformable tab is spaced a third distance from the inner wall upon application of a first force to the first deformable tab and the cap latch of the second deformable tab is spaced a fourth distance from the inner wall upon application of a second force to the second deformable tab, and wherein the third distance is smaller than the first distance and the fourth distance is smaller than the second distance.

14. The child-resistant package of claim 13, wherein the first distance is equal to the second distance.

15. The child-resistant package of claim 13, wherein the first force is applied between the side wall and the cap latch of the first deformable tab and the second force is applied between the side wall and the cap latch of the second deformable tab.

16. The child-resistant package of claim 10, wherein the outer wall includes a front wall segment, a rear wall segment, a first tab-receiving space segment, and a second tab-receiving space segment, and wherein the first tab-receiving space segment is separated from the second tab-receiving space segment by at least one of the front wall segment and the rear wall segment.

17. The child-resistant package of claim 16, wherein the body includes an upwardly extending lip that extends axially away from the front wall segment relative to the central axis and that includes a distal, upper end arranged to lie above an interface between the flip-top cap and the body to block access to the interface.

18. The child-resistant package of claim 10, wherein the outer wall includes a front wall segment, a rear wall segment, a first latch-support segment, and a second latch-support segment, wherein each body latch includes an upper edge, and wherein the upper edge is configured to guide the cap latch of each corresponding deformable tab as the flip-top cap is moved from the open position to the closed position to cause deformation of each deformable tab so that an upper surface of each cap latch engages a lower surface of each body latch when the flip-top cap reaches the closed position.

19. A child-resistant closure comprising a body including an upper wall formed to include a product-dispensing spout, an inner wall coupled to the upper wall and arranged to extend axially away from upper wall relative to a central axis of the body, wherein the inner wall includes an interior mount rim appended to an inside surface of the interior wall and adapted to mate with a discharge outlet formed on a container, and an outer wall coupled to the upper wall and arranged to extend axially away from the upper wall relative to the central axis, wherein the outer wall is located radially outward of the inner wall relative to the central axis, and wherein the inner wall and the outer wall cooperate to define a first tab-receiving space located at least partially radially between the outer wall and the inner wall relative to the central axis and a second tab-receiving space located at least partially radially between the outer wall and the inner wall relative to the central axis, a flip-top cap including a top wall, a side wall coupled to the top wall and arranged to extend axially away from the top wall, a first deformable tab coupled to the side wall and aligned with the first tab-receiving space, and a second deformable tab coupled to the side wall and aligned with the second tab-receiving space, and a hinge coupled between the body and the flip-top cap to support the flip-top cap for movement relative to the body from a closed position on the body covering the product-dispensing spout to an open position away from the body uncovering the product dispensing spout, wherein each deformable tab includes a cap latch extending in a radial direction from the deformable tab and arranged to engage a body latch coupled to the body when the flip top cap is in the closed position, and wherein the cap latch disengages the body latch upon deformation of each deformable tab so that the flip-top cap is movable from the closed position to the open position, and wherein each body latch is coupled to a latch-support panel included in the outer wall of the body, the latch-support panel has a first height from a lower end of the outer wall to an upper end of the latch-support panel, and each deformable tab has a second height from the side wall of the flip-top cap to a lower end of each deformable tab, the second height being greater than the first height, and wherein the body further includes first and second front wall supports and first and second rear wall supports that each extend radially relative to the central axis to interconnect the inner wall and the outer wall, the first and second front wall supports and the first and second rear wall supports extend at least partially along the first height of the latch support panel to reinforce the latch support panel.

20. The child-resistant closure of claim 19, wherein the first and second deformable tabs extend downwardly beyond a lower end of the inner wall of the body when the flip-top cap is in the closed position.

* * * * *